US006018296A

United States Patent [19]

Herzer

[11] Patent Number: 6,018,296

[45] Date of Patent: Jan. 25, 2000

[54] AMORPHOUS MAGNETOSTRICTIVE ALLOY WITH LOW COBALT CONTENT AND METHOD FOR ANNEALING SAME

[75] Inventor: Giselher Herzer, Bruchkoebel, Germany

[73] Assignee: Vacuumschmelze GmbH, Hanau, Germany

[21] Appl. No.: 08/890,612

[22] Filed: Jul. 9, 1997

[51] Int. Cl.[7] ..... G08B 13/14

[52] U.S. Cl. ..... 340/572; 340/551; 148/108; 148/122; 148/304; 148/307; 148/310; 148/311; 148/312; 148/315

[58] Field of Search ..... 340/572, 551, 340/825.36, 825.54; 148/108, 121, 122, 225, 304, 305, 307, 308, 310, 311, 312, 315; 75/430; 420/10, 16, 94, 95, 96, 97, 98

[56] References Cited

U.S. PATENT DOCUMENTS

| | | | |
|---|---|---|---|
| 4,236,946 | 12/1980 | Aboaf et al. | 148/108 |
| 4,268,325 | 5/1981 | O'Handley et al. | 148/108 |
| 4,484,184 | 11/1984 | Gregor et al. | 340/572 |
| 4,510,489 | 4/1985 | Anderson, III et al. | 340/572 |
| 5,252,144 | 10/1993 | Martis | 148/121 |
| 5,469,140 | 11/1995 | Liu et al. | 340/551 |
| 5,628,840 | 5/1997 | Hasegawa | 148/304 |
| 5,728,237 | 3/1998 | Herzer | 148/304 |

FOREIGN PATENT DOCUMENTS

| | | |
|---|---|---|
| WO 96/32518 | 10/1996 | WIPO . |
| WO 96/32731 | 10/1996 | WIPO . |

*Primary Examiner*—Benjamin C. Lee
*Attorney, Agent, or Firm*—Hill & Simpson

[57] ABSTRACT

A resonator for use in a marker in a magnetomechanical electronic article surveillance system is formed by a planar strip of an amorphous magnetostrictive alloy having a composition $Fe_aCo_bNi_cSi_xB_yM_z$ wherein a, b, c, x, y, and z are at % and a+b+c+x+y+z=100, a+b+c>75, a>15, b<20, c>5 and z<3, wherein M is at least one element selected from the group consisting of C, P, Ge, Nb, Mo, Cr and Mn, the amorphous magnetostrictive alloy having a resonant frequency $f_r$ which is a minimum at a field strength $H_{min}$ and having a linear B-H loop up to at least a field strength which is about 0.8 $H_{min}$ and a uniaxial anisotropy perpendicular to the plane of the strip with an anisotropy field strength $H_k$ which is at least as large as $H_{min}$ and, when driven by an alternating signal burst in the presence of a bias field $H_b$, producing a signal at the resonant frequency having an amplitude which is a minimum of approximately 50% of a maximum obtainable amplitude relative to the bias field $H_b$ in a range of $H_b$ between 0 and 10 Oe.

52 Claims, 11 Drawing Sheets

AMORPHOUS MAGNETOSTRICTIVE ALLOY WITH LOW COBALT CONTENT AND METHOD FOR ANNEALING SAME

BACKGROUND OF THE INVENTION

1. Field of the Invention

The present invention is directed to an amorphous magnetostrictive alloy for use in a marker employed in a magnetomechanical electronic article surveillance system, and in particular to such an amorphous magnetostrictive alloy having a low cobalt content, or being free of cobalt. The present invention is also directed to a method for annealing such a magnetostrictive alloy to produce a resonator and to a method for making a marker embodying such a resonator, and to a magnetomechanical electronic article surveillance system employing such a marker.

2. Description of the Prior Art

Various types of electronic article surveillance systems are known having the common feature of employing a marker or tag which is affixed to an article to be protected against theft, such as merchandise in a store. When a legitimate purchase of the article is made, the marker can either be removed from the article, or converted from an activated state to a deactivated state. Such systems employ a detection arrangement, commonly placed at all exits of a store, and if an activated marker passes through the detection system, this is detected by the detection system and an alarm is triggered.

One type of electronic article surveillance system is known as a harmonic system. In such a system, the marker is composed of ferromagnetic material, and the detector system produces an electromagnetic field at a predetermined frequency. When the magnetic marker passes through the electromagnetic field, it disturbs the field and causes harmonics of the predetermined frequency to be produced. The detection system is tuned to detect certain harmonic frequencies. If such harmonic frequencies are detected, an alarm is triggered. The harmonic frequencies which are generated are dependent on the magnetic behavior of the magnetic material of the marker, specifically on the extent to which the B-H loop of the magnetic material deviates from a linear B-H loop. In general, as the non-linearity of the B-H loop of the magnetic material increases, more harmonics are generated. A system of this type is disclosed, for example, in U.S. Pat. No. 4,484,184.

Such harmonic systems, however, have two basic problems associated therewith. The disturbances in the electromagnetic field produced by the marker are relatively short-range, and therefore can only be detected within relatively close proximity to the marker itself. If such a harmonic system is used in a commercial establishment, therefore, this means that the passageway defined by the electromagnetic transmitter on one side and the electromagnetic receiver on the other side, through which customers must pass, is limited to a maximum of about 3 feet. A further problem associated with such harmonic systems is the difficulty of distinguishing harmonics produced by the ferromagnetic material of the marker from those produced by other ferromagnetic objects such as keys, coins, belt buckles, etc.

Consequently, another type of electronic article surveillance system has been developed, known as a magnetomechanical system. Such a system is described, for example, in U.S. Pat. No. 4,510,489. In this type of system, the marker is composed of an element of magnetostrictive material, known as a resonator, disposed adjacent a strip of magnetizable material, known as a biasing element. Typically (but not necessarily) the resonator is composed of amorphous ferromagnetic material and the biasing element is composed of crystalline ferromagnetic material. The marker is activated by magnetizing the bias element and is deactivated by demagnetizing the bias element.

In such a magnetomechanical system, the detector arrangement includes a transmitter which transmits pulses in the form of RF bursts at a frequency in the low radio-frequency range, such as 58 kHz. The pulses (bursts) are emitted (transmitted) at a repetition rate of, for example 60 Hz, with a pause between successive pulses. The detector arrangement includes a receiver which is synchronized (gated) with the transmitter so that it is activated only during the pauses between the pulses emitted by the transmitter. The receiver "expects" to detect nothing in these pauses between the pulses. If an activated marker is present between the transmitter and the receiver, however, the resonator therein is excited by the transmitted pulses, and will be caused to mechanically oscillate at the transmitter frequency, i.e., at 58 kHz in the above example. The resonator emits a signal which "rings" at the resonator frequency, with an exponential decay time ("ring-down time"). The signal emitted by the activated marker, if it is present between the transmitter and the receiver, is detected by the receiver in the pauses between the transmitted pulses and the receiver accordingly triggers an alarm. To minimize false alarms, the detector usually must detect a signal in at least two, and preferably four, successive pauses.

Since both harmonic and magnetomechanical systems are present in the commercial environment, a problem exists known as "pollution," which is the problem of a marker designed to operate in one type of system producing a false alarm in the other type of system. This most commonly occurs by a conventional marker intended for use in a magnetomechanical system triggering a false alarm in a harmonic system. This arises because, as noted above, the marker in a harmonic system produces the detectable harmonics by virtue of having a non-linear B-H loop. A marker with a linear B-H loop would be "invisible" to a harmonic surveillance system. A non-linear B-H loop, however, is the "normal" type of B-H loop exhibited by magnetic material; special measures have to be taken in order to produce material which has a linear B-H loop. Amorphous magnetostrictive material is disclosed in U.S. Pat. No. 5,628,840 which is stated therein to exhibit such a linear B-H loop. This material, however, still exhibits the problem of having a relatively long ring-down time, which makes it difficult to distinguish the signal therefrom from spurious RF sources.

A further desirable feature of a resonator for use in a marker in a magnetomechanical surveillance system is that the resonant frequency of the resonator have a low dependency on the pre-magnetization field strength produced by the bias element. The bias element is used to activate and deactivate the marker, and thus is easily magnetizable and demagnetizable. When the bias element is magnetized in order to activate the marker, the precise field strength of the magnetic field produced by the bias element cannot be guaranteed. Therefore, it is desirable that, at least within a designated field strength range, the resonant frequency of the resonator not change significantly for different magnetization field strengths. This means $df_r/dH_b$ should be small, wherein $f_r$ is the resonant frequency, and $H_b$ is the strength of the magnetization field produced by the bias element.

Upon deactivation of the marker, however, it is desirable that a very large change in the resonant frequency occur upon removal of the magnetization field. This ensures that a deactivated marker, if left attached to an article, will resonate, if at all, at a resonant frequency far removed from the resonant frequency that the detector arrangement is designed to detect.

Lastly, the material used to make the resonator must have mechanical properties which allow the resonator material to be processed in bulk, usually involving a thermal treatment (annealing) in order to set the magnetic properties. Since amorphous metal is usually cast as a continuous ribbon, this means that the ribbon must exhibit sufficient ductility so as to be processable in a continuous annealing chamber, which means that the ribbon must be unrolled from a supply reel, passed through the annealing chamber, and possibly rewound after annealing. Moreover, the annealed ribbon is usually cut into small strips for incorporation of the strips into markers, which means that the material must not be overly brittle and its magnetic properties, once set by the annealing process, must not be altered or degraded by cutting the material.

A large number of alloy compositions are known in the amorphous metal field in general, and a large number of amorphous alloy compositions have also been proposed for use in electronic article surveillance systems of both of the above types.

PCT Applications WO 96/32731 and WO 96/32518, corresponding to U.S. Pat. No. 5,469,489, disclose a glassy metal alloy consisting essentially of the formula $Co_aFe_bNi_cM_dB_eSi_fC_g$, wherein M is selected from molybdenum and chromium and a, b, c, d, e, f and g are at %, a ranges from about 40 to about 43, b ranges from about 35 to about 42, c ranges from 0 to about 5, d ranges from 0 to about 3, e ranges from about 10 to about 25, f ranges from 0 to about 15 and g ranges from 0 to about 2. The alloy can be cast by rapid solidification into ribbon, annealed to enhance the magnetic properties thereof, and formed into a marker that is especially suited for use in magnetomechanically actuated article surveillance systems. The marker is characterized by relatively linear magnetization response in a frequency regime wherein harmonic marker systems operate magnetically. Voltage amplitudes detected for the marker are high, and interference between surveillance systems based on mechanical resonance and harmonic re-radiance is precluded.

U.S. Pat. No. 5,469,140 discloses a ribbon-shaped strip of an amorphous magnetic alloy which is heat treated, while applying a transverse saturating magnetic field. The treated strip is used in a marker for a pulsed-interrogation electronic article surveillance system. A preferred material for the strip is formed of iron, cobalt, silicon and boron with the proportion of cobalt exceeding 30 at %.

U.S. Pat. No. 5,252,144 proposes that various magnetostrictive alloys be annealed to improve the ring-down characteristics thereof. This patent, however, does not disclose applying a magnetic field during heating.

Many alloy compositions which achieve the above characteristics in their most preferred form and combination (i.e., with all of the above characteristics being optimized) contain relatively large amounts of cobalt. Among the raw materials commonly employed in alloy compositions for producing amorphous material, cobalt is the most expensive. Therefore, amorphous metal products made from an alloy composition with a relatively high cobalt content are correspondingly expensive. In the electronic article surveillance system field, particularly in the field of magnetomechanical surveillance systems, there exists a need for an amorphous alloy which can serve to form the resonator in the article marker which has a relatively low cobalt content, or is cobalt-free, and which is therefore correspondingly reduced in price. The low cobalt content, or the absence of cobalt, however, should not significantly deteriorate the aforementioned magnetic and mechanical properties of the alloy.

Amorphous alloy is commonly cast in "raw" form as a ribbon, and is subsequently subjected to customized processing in order to give the raw ribbon a particular set of desired magnetic properties. Typically, such processing includes annealing the ribbon in a chamber while simultaneously subjecting the ribbon during the annealing to a magnetic field. Most commonly, the magnetic field is oriented transversely relative to the ribbon, i.e., in a direction perpendicular to the longitudinal axis (longest extent) of the ribbon, and in the plane of the ribbon. It is also known, however, to anneal amorphous metal alloy while subjecting the alloy to a magnetic field oriented perpendicularly to the plane of the ribbon or strip, i.e., a magnetic field having a direction parallel to the planar surface normal of the ribbon or strip. Annealing in this manner is disclosed in U.S. Pat. No. 4,268,325. Although a number of cobalt-free alloys are disclosed therein, a number of cobalt-containing alloys are also described. Among the specific examples of cobalt-containing alloy compositions which are provided in U.S. Pat. No. 4,268,325, the lowest cobalt content is 15 at %, and other examples are given wherein the cobalt content is as high as 74 at %. Moreover, the generalized formula which is disclosed in this patent is a cobalt-containing alloy, and is stated to contain cobalt in a range from about 40 to 80 at %. Only some details of the magnetic properties of alloys formed according to this patent are described therein, however, exemplary B-H loops for such alloys are shown. Based on these B-H loops, which are non-linear, the alloys disclosed in this patent would be suitable for use only in harmonic article surveillance systems. Even if some of those alloys had undisclosed magnetostrictive properties, they would still exhibit the aforementioned non-linear B-H loop, and thus would not solve the aforementioned problem of pollution.

SUMMARY OF THE INVENTION

It is an object of the present invention to provide an amorphous magnetostrictive alloy, and a method for processing same, in order to produce a resonator having properties suitable for use in magnetomechanical electronic article surveillance system, at a lower cost than conventional resonators.

A further object is to provide an amorphous magnetostrictive alloy which exhibits a sufficiently linear magnetic behavior so as to make a marker embodying such a resonator invisible to a harmonic article surveillance system.

It also an object of the present invention to provide a marker embodying such a resonator, and a method for making such a marker, suitable for use in a magnetomechanical electronic article surveillance system.

Another object of the present invention is to provide a magnetomechanical electronic article surveillance system which is operable with a low-cost marker having a resonator composed of amorphous magnetostrictive alloy.

The above objects are achieved in a resonator, a marker embodying such a resonator, and a magnetomechanical electronic article surveillance system employing such a marker, wherein the resonator is composed of an amorphous magnetostrictive alloy having a low cobalt-content wherein the raw amorphous magnetostrictive alloy is annealed in ribbon or strip form, The resonator having a resonant frequency $f_r$ which is a minimum at a field strength $H_{min}$ and having a linear B-H loop up to at least a field strength which is about 0.8 $H_{min}$ and uniaxial anisotropy perpendicular to the plane of the strip with an anisotropy field strength $H_k$ which is at least as large as $H_{min}$.

The aforementioned uniaxial anisotropy in the inventive resonator has two components, namely direction and magnitude. The direction, i.e., perpendicular to the plane of the strip, is set by the annealing process. This direction can be set by annealing the ribbon or strip in the presence of a magnetic field oriented substantially perpendicularly to the plane of the ribbon or strip and out of that plane (non-transverse field), or by introducing crystallinity into the ribbon or strip, from the top and bottom, each to a depth of about 10% of the strip or ribbon thickness. Thus, as used herein, "amorphous" (when referring to the resonator) means a minimum of about 80% amorphous (when the resonator is viewed in a cross-section perpendicular to its plane).

The anisotropy field strength (magnitude) is set by a combination of the annealing process and alloy composition, with the order of magnitude being primarily varied (adjusted) by adjusting the alloy composition, with changes from an average (nominal) magnitude then being achievable within about ±40% of the nominal value.

As used herein, "low cobalt content" encompasses a cobalt content of 0 at %, i.e., a cobalt-free composition. A preferred generalized formula for the alloy composition which, when annealed as described above, produces a resonator having the desired properties for use in a marker in a magnetomechanical electronic article surveillance system, is as follows:

$$Fe_aCo_bNi_cSi_xB_yM_z$$

wherein a, b, c, x, y, and z are at %, wherein M is one or more glass formation-promoting elements such as C,P,Ge, Nb and/or Mo, and/or one or more transition metals such as Cr and/or Mn, and wherein $a+b+c>75$ $a>15$ $0<b<20$ $c>5$ $z<3$ with x and y comprising the remainder, so that $a+b+c+x+y+z=100$. (In the above range designations, and as used elsewhere herein, all numerical lower and upper designations include the value of the designation itself and should be interpreted as if preceded by "about", i.e., small variations from the literally specified designations are tolerable.) A resonator having an alloy with the above composition, after annealing in a magnetic field perpendicular to the plane of the ribbon, when excited to mechanically oscillate at a resonant frequency in the presence of a bias magnetic field, emits a signal having a high initial amplitude, and the resonant frequency of the processed alloy (resonator) exhibits a minimal change with changes in the pre-magnetization field.

A resonator produced in accordance with the invention has virtually no probability of triggering an alarm in a harmonic security system, because it has a sufficiently linear magnetic behavior (i.e., no significant "kink" in the B-H loop) up to a field strength in a range of about 4–5 Oe, which is set by the aforementioned annealing in a magnetic field perpendicular to the plane of the ribbon or strip, so as to make the resonator invisible to a harmonic article surveillance system. Also contributing to solving the pollution problem is that a resonator produced in accordance with the invention has a resonant frequency which changes by at least 1.2 kHz when the pre-magnetization field is removed, i.e., when it is switched from an activated condition to a deactivated condition.

For a resonator produced in accordance with the invention $H_{min}$ is in a range between about 5 and about 8 Oe. The anisotropy field $H_k$ is a minimum of about 6 Oe. Typically $H_{min}$ is about 0.8 $H_k$.

A resonator produced in accordance with the invention has a resonant frequency $f_r$ which changes, in a pre-magnetization field strength $H_b$ in a range between about 4 and about 8 Oe, by an amount which is less than about 400 Hz/Oe, i.e., $|df_r/dH_b|<400$ Hz/Oe. In preferred embodiments, the dependency of the resonant frequency on the pre-magnetization field strength lies close to 0.

The aforementioned resonator is formed by subjecting the raw alloy (as cast) to a perpendicular, non-transverse magnetic field while the alloy, such as in the form of ribbon, is being heated. Heating the ribbon can be accomplished, for example, by passing an electrical current through the ribbon. Preferably, the thermal treatment of the ribbon takes place in a temperature range between about 250° C. and about 430° C., and the thermal treatment lasts for less than one minute.

In a further embodiment of the composition, the alloy has a cobalt content of less than 10 at % and in another embodiment the alloy has a nickel content of at least 10 at % and a cobalt content of less than 4 at %. In a further embodiment the alloy has an iron content which is less than 30 at % and a nickel content grater than 30 at %. In another embodiment $a+b+c>79$.

Although as noted above it is preferred to anneal the raw amorphous alloy after casting in a magnetic field which is perpendicular to the plane of the amorphous metal ribbon, the aforementioned magnetic properties which are desirable in a magnetomechanical article surveillance system can be achieved by annealing the amorphous ribbon in the presence of an obliquely-directed magnetic field, i.e., a magnetic field having a direction in the plane of the amorphous ribbon or strip, but at an angle which significantly deviates from 90° relative to the longitudinal axis (longest direction) of the ribbon. Annealing in a magnetic field which is a combination (vectorial addition) of a perpendicular field and an oblique field can also be used.

A marker for use in a magnetomechanical surveillance system has a resonator composed of an alloy having the above formula and properties, contained in a housing adjacent a bias element composed of ferromagnetic material. Such a marker is suitable for use in a magnetomechanical surveillance system having a transmitter which emits successive RF bursts at a predetermined frequency, with pauses between the bursts, a detector tuned to detect signals at the predetermined frequency, a synchronization circuit which synchronizes operation of the transmitter circuit and the receiver circuit so that the receiver circuit is activated to look for a signal at the predetermined frequency in the pauses between the bursts, and an alarm which is triggered if the detector circuit detects a signal, which is identified as originating from a marker, within at least one of the pauses between successive pulses. Preferably the alarm is generated when a signal is detected which is identified as originating from a marker in more than one pause.

DESCRIPTION OF THE PREFERRED EMBODIMENTS

Figure 1:
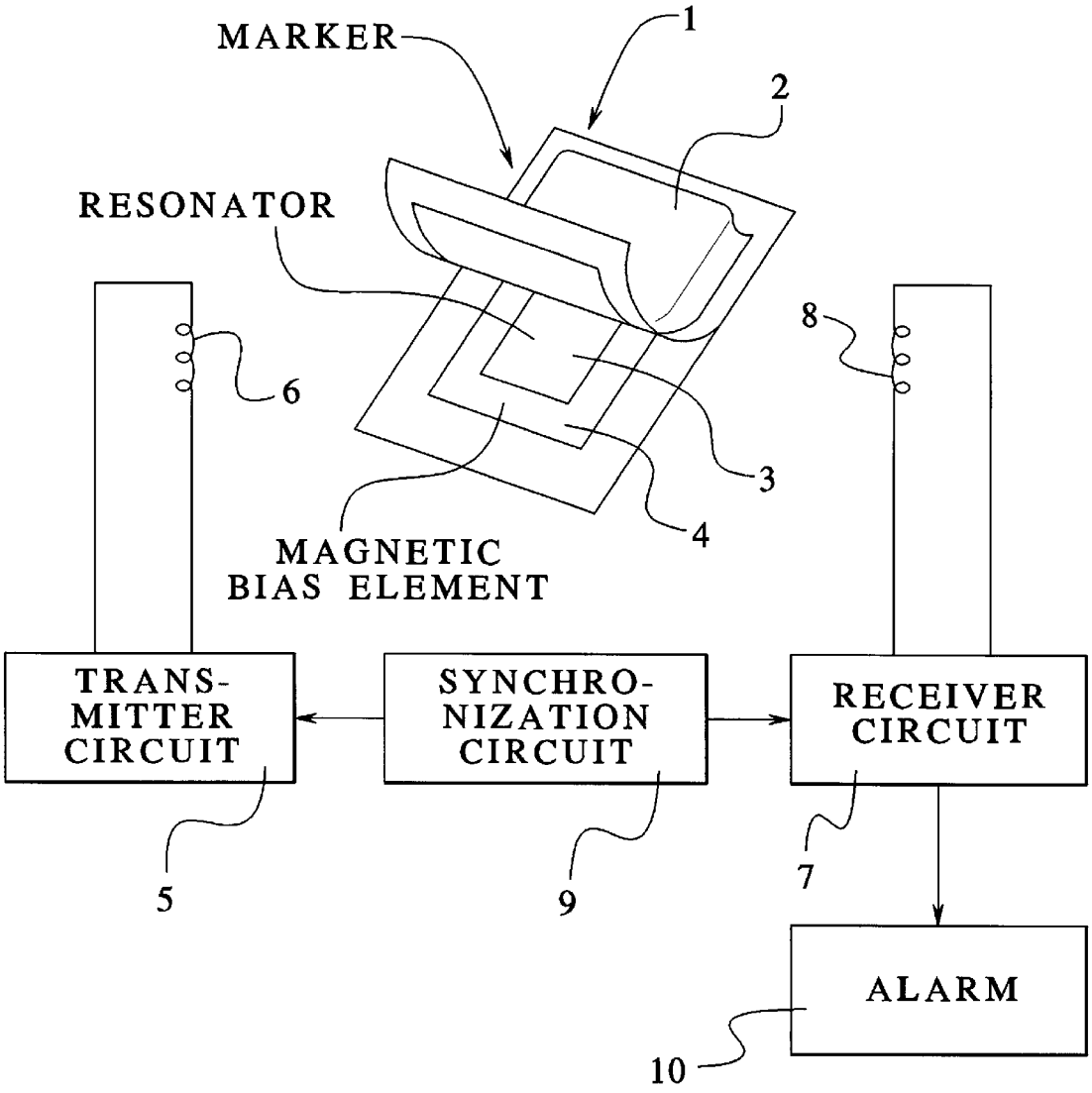
FIG. 1 shows a marker, with the upper part of its housing partly pulled away to show internal components, having a resonator made in accordance with the principles of the present invention, in the context of a schematically illustrated magnetomechanical article surveillance system.
Figure 2A:
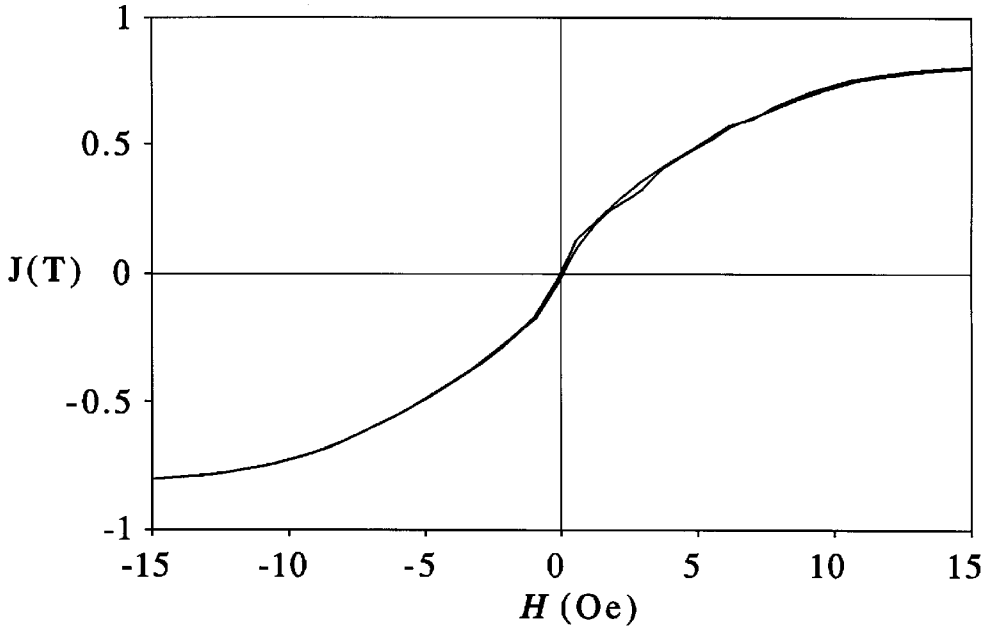
FIG.2a (PRIOR ART)
FIGS. 2*a* and 2*b* respectively show a B-H loop and the relationship of the resonant frequency and signal amplitude relative to the pre-magnetization field for a known amorphous alloy in as cast form, i.e., without any processing thereof.
Figure 2B:
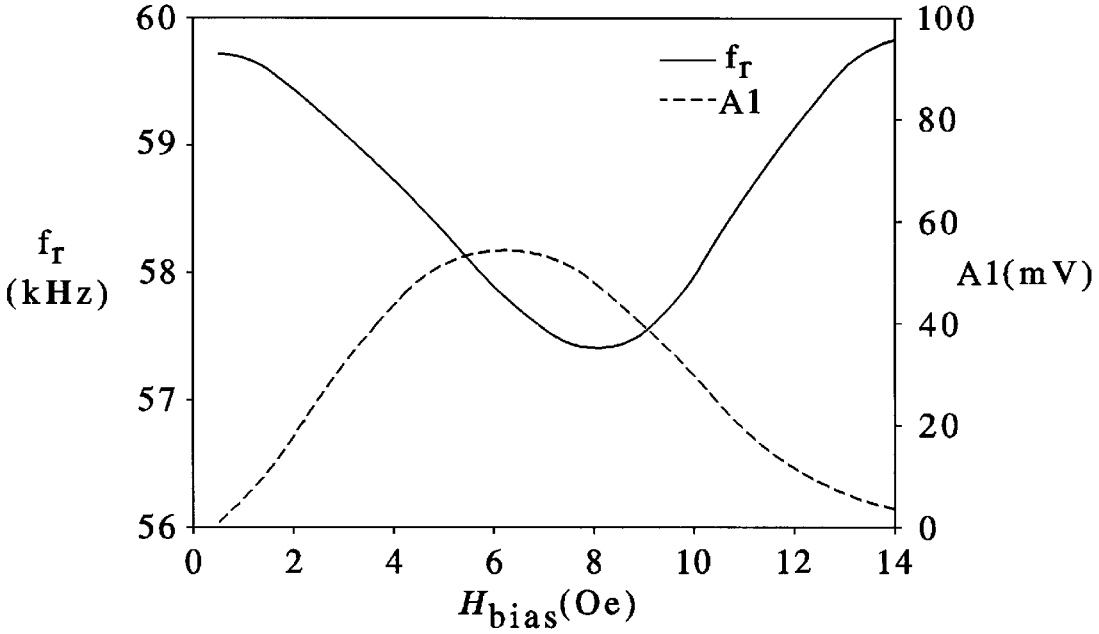
FIG.2b (PRIOR ART)

FIG. 1 illustrates a magnetomechanical electronic article surveillance system employing a marker 1 having a housing 2 which contains a resonator 3 and magnetic bias element 4. The resonator 3 is cut from a ribbon of annealed amorphous magnetostrictive metal having a composition according to the formula $$Fe_aCo_bNi_cSi_xB_yM_z$$

wherein a, b, c, x, y and z are at %, wherein M is one or more glass formation-promoting elements such as C,P,Ge,Nb and/or Mo, and/or one or more transition metals such as Cr and/or Mn, and wherein $a+b+c>75$ $a>15$ $0<b<20$ $c>5$ $z<3$ with x and y comprising the remainder, so that $a+b+c+x+y+z=100$. The amorphous ribbon which was annealed and cut to produce the resonator 3 was annealed in the presence of a magnetic field having a direction perpendicular to the plane of the ribbon, i.e., parallel to a surface normal of the ribbon. The resonator 3, when excited as described below so as to mechanically oscillate, produces a signal at a resonant frequency having an initially high amplitude, making detection thereof reliable in the magnetomechanical electronic article surveillance system shown in FIG. 1.

In a further embodiment of the composition, the alloy has a cobalt content of less than 10 at % and in another embodiment the alloy has a nickel content of at least 10 at % and a cobalt content of less than 4 at %. In a further embodiment the alloy has an iron content which is less than 30 at % and a nickel content grater than 30 at %. In another embodiment $a+b+c>79$.

The marker 1 is an activated condition when the magnetic bias element is magnetized, typically for the present purposes in a range between 1 and 6 Oe, and the resonator 3 has a linear magnetic behavior, i.e., a linear B-H loop, at least in a range up to about 4–5 Oe, this being set by the aforementioned annealing in a perpendicular magnetic field. Moreover, the resonant frequency $f_r$ of the resonator 3 changes by at least 1.2 kHz when the magnetic field produced by the magnetic bias element 4 is removed, i.e., when the magnetic bias element 4 is demagnetized in order to deactivate the marker 1. The resonant frequency $f_r$ of the resonator 3 will have a minimum at some field strength, which is herein designated $H_{min}$. The B-H loop of the resonator 3 is linear up to at least a field strength which is about 0.8 $H_{min}$ and has an anisotropy field strength $H_k$ which is at least as large as, and may be greater than, $H_{min}$. The anisotropy field strength $H_k$ will be a minimum of about 6 Oe. Typically $H_{min}$ is about 0.8 $H_k$. Thus, $H_{min}$ will be in a range of about 5 to about 8 Oe. The resonant frequency $f_r$ of the inventive resonator 3 changes dependent on changes in the bias field $H_b$ produced by the magnetic bias element 4 by a minimal amount, preferably less than 400 Hz/Oe, and in some instances can exhibit such a change which is close to 0.

The magnetomechanical surveillance system shown in FIG. 1 operates in a known manner. The system, in addition to the marker 1, includes a transmitter circuit 5 having a coil or antenna 6 which emits (transmits) RF bursts at a predetermined frequency, such as 58 kHz, at a repetition rate of, for example, 60 Hz, with a pause between successive bursts. The transmitter circuit 5 is controlled to emit the aforementioned RF bursts by a synchronization circuit 9, which also controls a receiver circuit 7 having a reception coil or antenna 8. If an activated marker 1 (i.e., a marker having a magnetized bias element 4) is present between the coils 6 and 8 when the transmitter circuit 5 is activated, the RF burst emitted by the coil 6 will drive the resonator 3 to oscillate at a resonant frequency of 58 kHz (in this example), thereby generating a signal having an initially high amplitude, which decays exponentially.

The synchronization circuit 9 controls the receiver circuit 7 so as to activate the receiver circuit 7 to look for a signal at the predetermined frequency 58 kHz (in this example) within first and second detection windows. Typically, the synchronization circuit 9 will control the transmitter circuit 5 to emit an RF burst having a duration of about 1.6 ms, in which case the synchronization circuit 9 will activate the receiver circuit 7 in a first detection window of about 1.7 ms duration which begins at approximately 0.4 ms after the end of the RF burst. During this first detection window, the receiver circuit 7 integrates any signal at the predetermined frequency, such as 58 kHz, which is present. In order to produce an integration result in this first detection window which can be reliably compared with the integrated signal from the second detection window, the signal emitted by the marker 1, if present, should have a relatively high amplitude.

When the resonator 3 made in accordance with the invention is driven by the transmitter circuit 5 at 18 mOe, the receiver coil 8 is a close-coupled pick-up coil of 100 turns, and the signal amplitude is measured at about 1 ms after an a.c. excitation burst of about 1.6 ms duration, it produces an amplitude of about 40 mV in the first detection window. In general, $A1 \partial N \cdot W \cdot H_{ac}$ wherein N is the number of turns of the receiver coil, W is the width of the resonator and $H_{ac}$ is the field strength of the excitation (driving) field. The specific combination of these factors which produces A1 is not significant.

Subsequently, the synchronization circuit 9 deactivates the receiver circuit 7, and then re-activates the receiver circuit 7 during a second detection window which begins at approximately 6 ms after the end of the aforementioned RF burst. During the second detection window, the receiver circuit 7 again looks for a signal having a suitable amplitude at the predetermined frequency (58 kHz). Since it is known that a signal emanating from a marker 1, if present, will have a decaying amplitude, the receiver circuit 7 compares the amplitude of any 58 kHz signal detected in the second detection window with the amplitude of the signal detected in the first detection window. If the amplitude differential is consistent with that of an exponentially decaying signal, it is assumed that the signal did, in fact, emanate from a marker 1 present between the coils 6 and 8, and the receiver circuit 7 accordingly activates an alarm 10.

This approach reliably avoids false alarms due to spurious RF signals from RF sources other than the marker 1. It is assumed that such spurious signals will exhibit a relatively constant amplitude, and therefore even if such signals are integrated in each of the first and second detection windows, they will fail to meet the comparison criterion, and will not cause the receiver circuit 7 to trigger the alarm 10.

Moreover, due to the aforementioned significant change in the resonant frequency $f_r$ of the resonator 3 when the bias field $H_b$ is removed, which is at least 1.2 kHz, it is assured that when the marker 1 is deactivated, even if the deactivation is not completely effective, the marker 1 will not emit a signal, even if excited by the transmitter circuit 5, at the predetermined resonant frequency, to which the receiver circuit 7 has been tuned.

Upon surveying conventional amorphous materials, and their magnetic properties, used in various types of article surveillance systems, the inventor noted that the frequency change of 400 Hz/Oe at approximately 6 Oe for alloys as described, for example, in the aforementioned U.S. Pat. No. 5,628,840, also approximately corresponds to the value of the frequency change of non-linear embodiments described, for example, in PCT Application WO 90/03652.

The inventor also noticed, however, for the exemplary embodiment shown in FIG. 1, that at a somewhat different test field strength of approximately 8 Oe, the change of the resonant frequency $f_r$ relative to the test field strength, i.e., $|df_r/dH_b|$, exhibits a value close to 0, but adequate signal amplitude is still present. This caused the inventor to recognize that the pre-magnetization field strength might be adapted in such a resonator so that it comes to lie where $|df_r/dH_b|=0$. As an alternative, it was thought to be possible that by modifying the composition or the geometry of the strip, so as to modify the bias field, so that where $|df_r/dH_b|=0$ applies corresponds to that value of the test field strength which is applied in standard magnetomechanical article surveillance systems, for example, a field strength of between 6 and 7 Oe. This would achieve a resonator having a resonant frequency which is extremely insensitive to fluctuations of the test field strength (bias field strength) such as occur, for example, due to different orientations of the marker in which the resonator is contained in the earth's magnetic field, or due to fluctuations in the characteristics of the ferromagnetic bias element which produces the field $H_b$. A marker with a less fluctuating resonant frequency than is achieved by conventional markers would result in a higher detection rate in the monitoring zone in a magnetomechanical electronic article surveillance system.

Subsequent trials demonstrated that the above holds true, but it was found that the properties of the resonator exhibit a large scatter, because they are influenced by very slight deviations of the manufacturing process. Moreover, the aforementioned disadvantage of pollution still remained, namely the trials showed that the B-H loop of experimental resonators was non-linear, so that the resonator would trigger an alarm in a harmonic surveillance system.

Figure 3A:
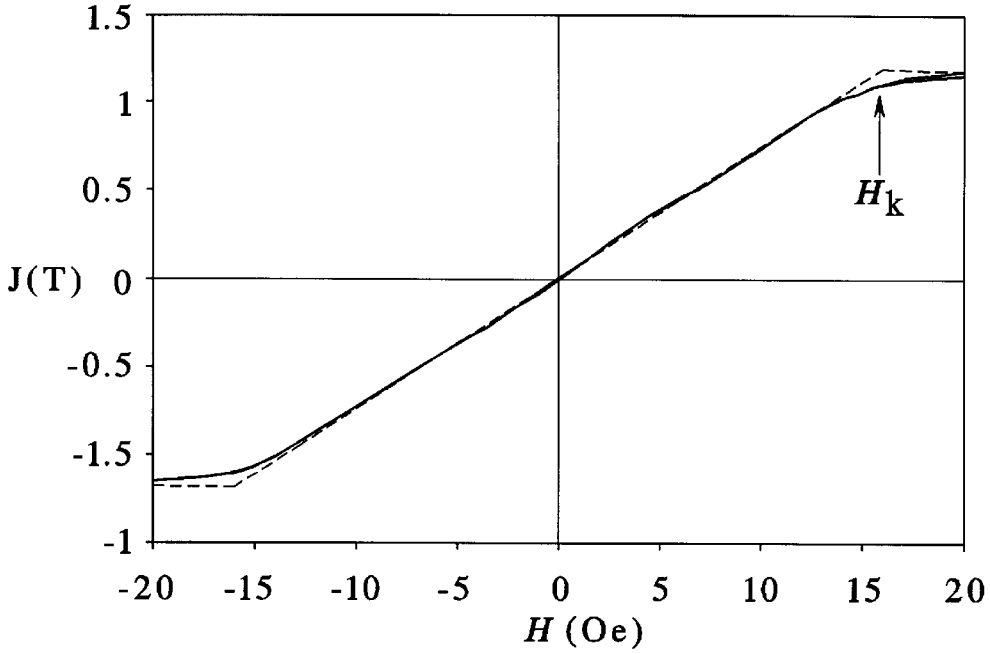
FIG.3a (PRIOR ART)
FIGS. 3*a* and 3*b* respectively show the B-H loop and the dependency of the resonant frequency and the signal amplitude on the pre-magnetization field for a known amorphous alloy annealed in a transverse magnetic field.
Figure 3B:
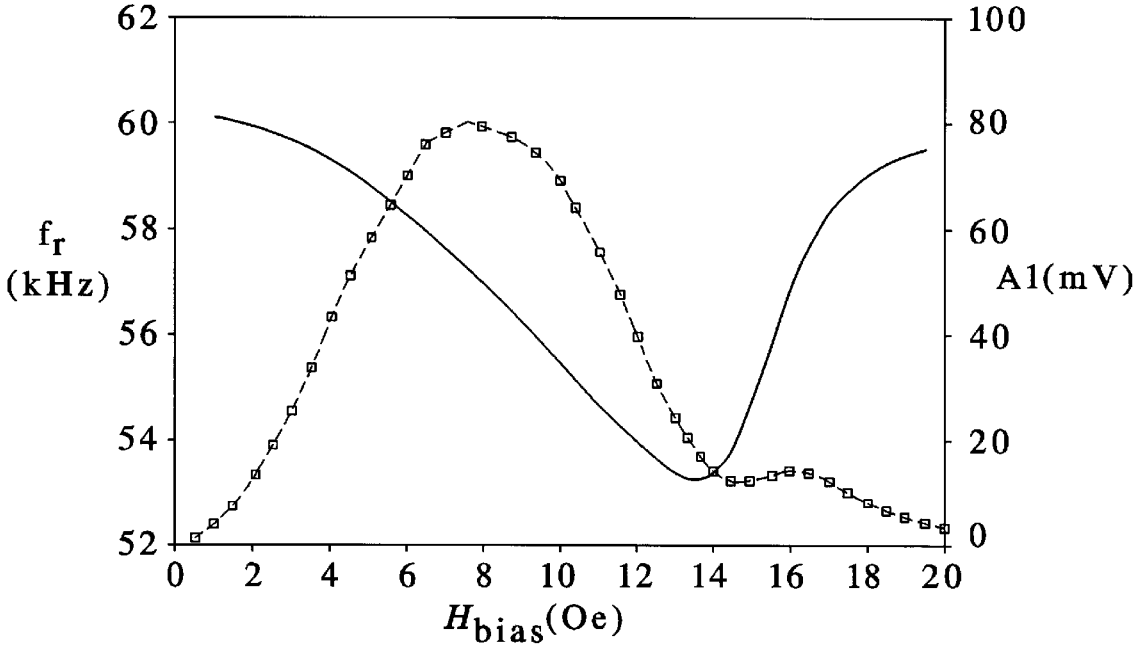
FIG.3b (PRIOR ART)

The properties of the trial samples were then attempted to be modified by conducting annealing in a transverse field. As shown in FIGS. 3*a* and 3*b*, however, this resulted in the signal amplitude A1 becoming extremely small at $|df_r/dH_b|=0$, thereby making signal detection extremely difficult. This seemed to be a problem of a fundamental nature.

A significant breakthrough occurred when the strips were not thermally treated in a magnetic field oriented transversely to the longitudinal axis of the ribbon and in the plane of the ribbon, but instead conducting a thermal treatment of the ribbon in a magnetic field oriented perpendicularly to the longitudinal direction of the ribbon, and not in the plane of the ribbon, i.e., a magnetic field having a direction parallel to a planar surface normal of the ribbon.

Figure 4:
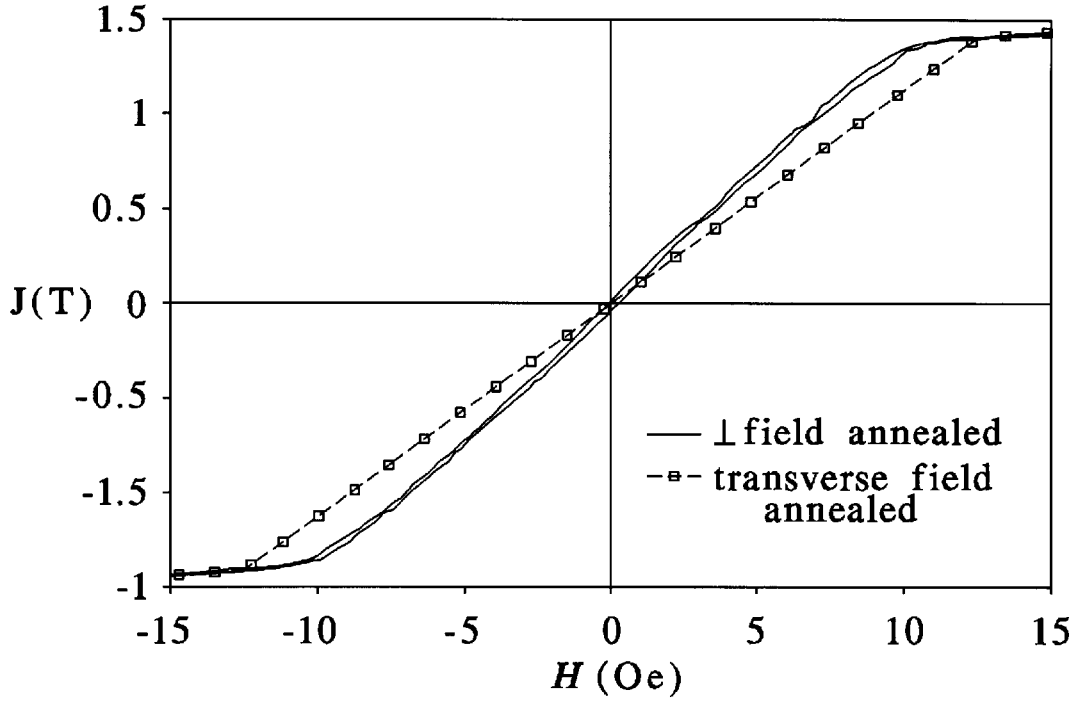
FIG. 4 shows the B-H loop for a first exemplary alloy composition in accordance with the invention, both annealed in a perpendicular magnetic field in accordance with the invention, and in a transverse magnetic field, not in accordance with the invention.
Figure 5:
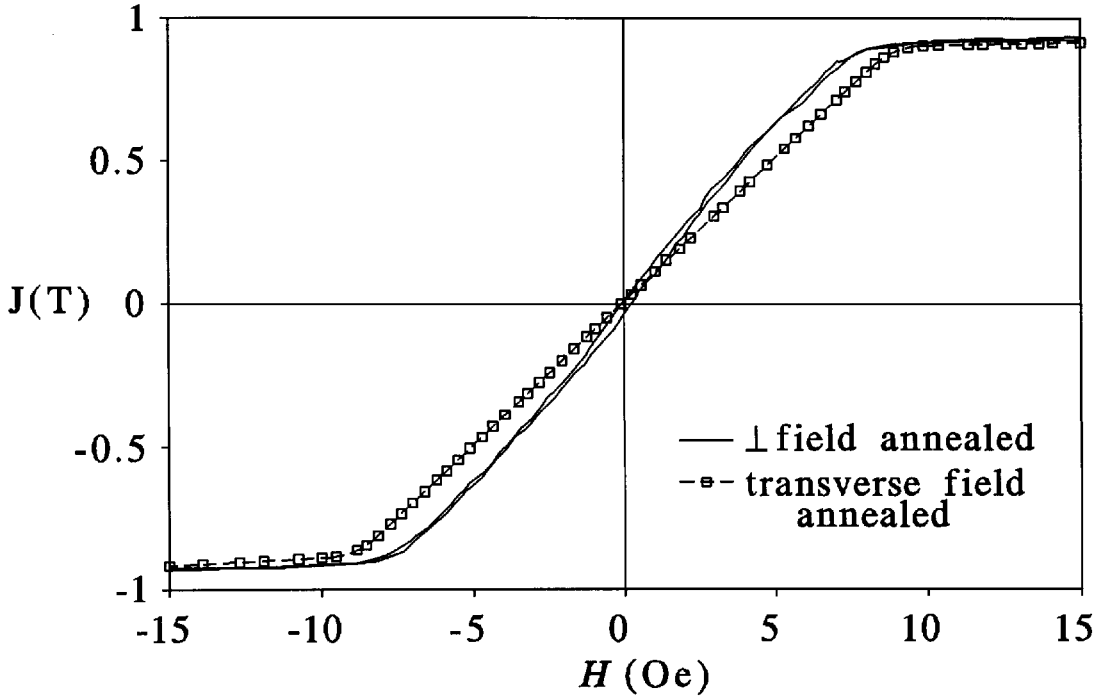
FIG. 5 shows the B-H loop for a second exemplary alloy composition in accordance with the invention, both annealed in a perpendicular magnetic field in accordance with the invention, and in a transverse magnetic field, not in accordance with the invention.

FIGS. 4 and 5 show the magnetic behavior (B-H loop) of processed alloys having different compositions according to the inventive formula. Respective samples of the "as cast" alloys were subjected to annealing in the presence of a perpendicular field in accordance with the invention, and other samples were subjected to annealing in the presence of a transverse field. As can be seen in FIGS. 4 and 5, both types of annealing result in a substantially linear magnetization behavior. This is as expected, because the result of either type of magnetization produces a uniaxial anisotropy perpendicular to the plane of the ribbon from which the strips are cut, which is a precondition to achieving such linear behavior.

An unexpected result, however, was the magnetoelastic properties which were exhibited by the alloys designated in FIGS. 4 and 5 upon annealing in the presence of a perpendicular (non-transverse) field so as to produce a uniaxial anisotropy perpendicular to the plane of the ribbon (strip). These properties are respectively shown for the two compositions in FIGS. 6 and 7. As can be seen by comparing FIGS. 6 and 7 to the properties exemplified by conventionally transverse field annealed amorphous magnetostrictive material shown in FIG. 3*b*, a resonator (processed alloys) in accordance with the invention still maintains a sufficiently high signal amplitude when the resonant frequency is at a minimum, i.e., at a location at which $|df_r/dH_b|\approx 0$.

Figure 6:
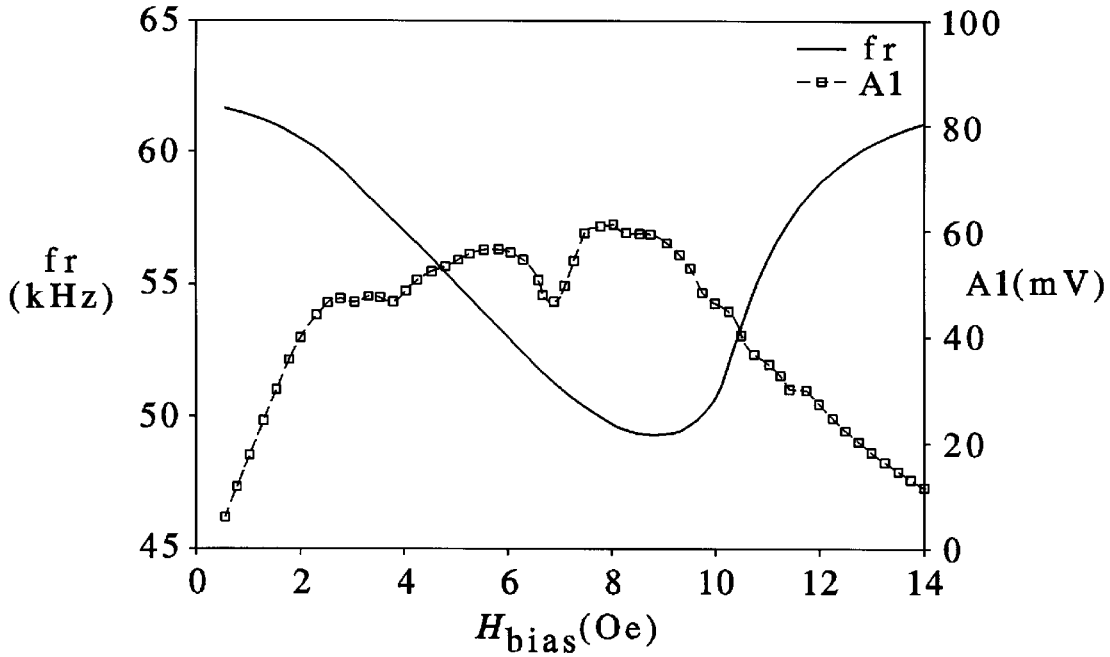
FIG. 6 shows the dependency of the resonant frequency and the signal amplitude for the alloy of FIG. 4 after annealing in a perpendicular field.
Figure 7:
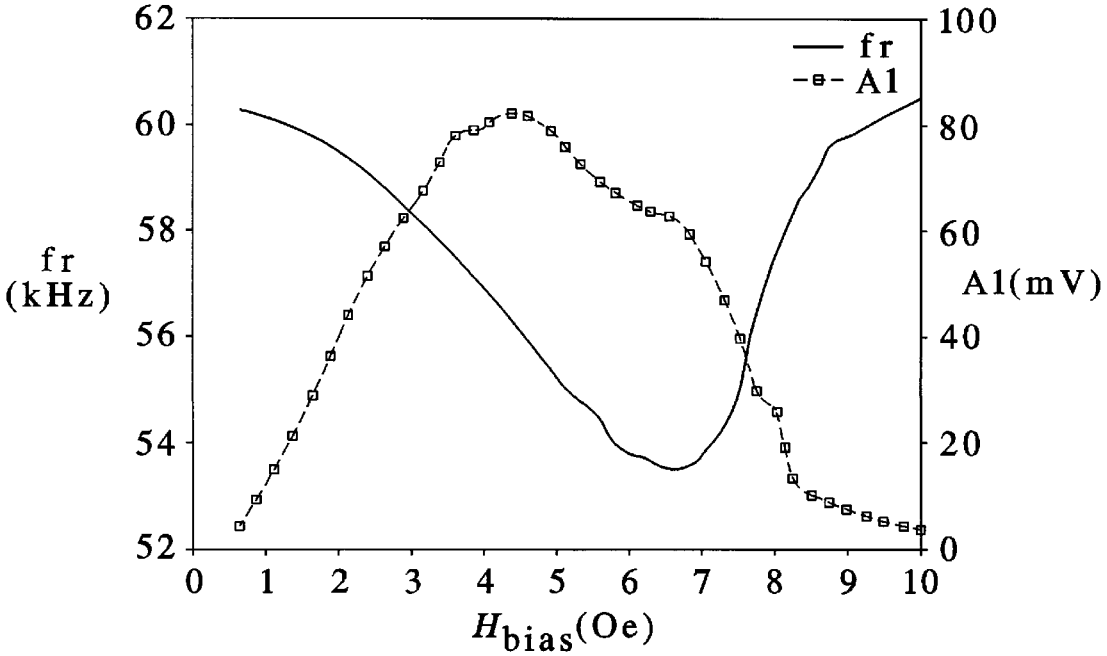
FIG. 7 shows the respective dependencies of the resonant frequency and the signal amplitude on the bias field for the alloy of FIG. 5 after annealing in a perpendicular field.
Figure 8:
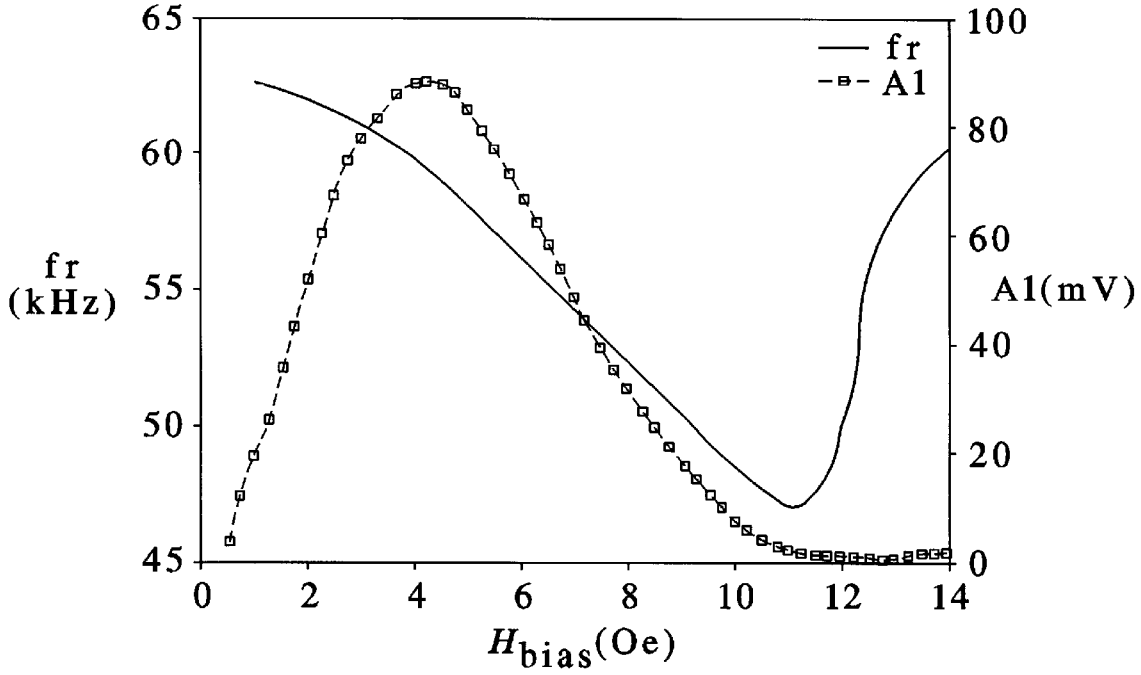
FIG. 8 shows the respective dependencies of the resonant frequency and the signal amplitude on the bias field of the alloy of FIGS. 4 and 6, when annealed in a transverse magnetic field not in accordance with the invention.
Figure 9:
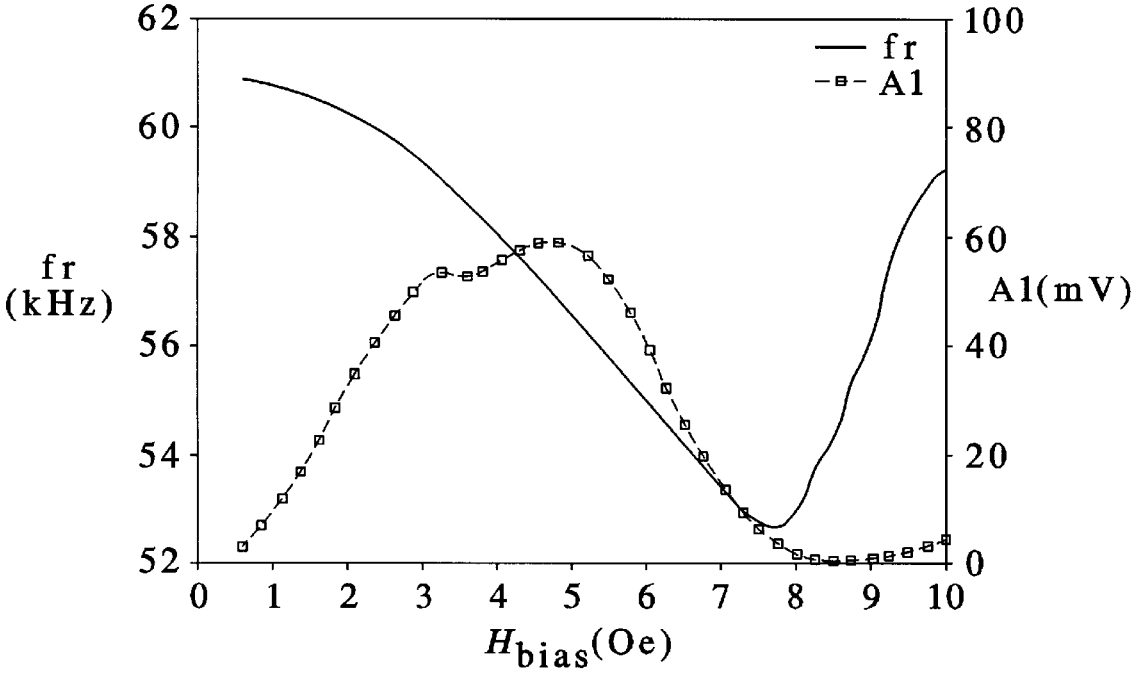
FIG. 9 shows the dependency of the resonant frequency and the signal amplitude of the alloy of FIGS. 5 and 7, when annealed in a transverse magnetic field not in accordance with the invention.

In order to test the source in the processing which produced the results shown in FIGS. 6 and 7, other alloy samples of the same composition were processed conventionally by annealing in a transverse magnetic field. This produced resonators having the properties shown in FIGS. 8 and 9. As can be seen in FIGS. 8 and 9, a barely detectable signal amplitude is present at the location at which the resonant frequency has a minimum. A high-signal amplitude can be found only in a central portion of the curves shown in FIGS. 8 and 9, however, at that location the change in the resonant frequency in dependence on the field strength is extremely high. At 6.5 Oe., for example, the processed alloy shown in FIG. 8 exhibits a value of $|df_r/dH_b|\approx 1900$ Hz/Oe, and the processed alloy shown in FIG. 9 exhibits a lower value at that location, but which still amounts to approximately 1600 Hz/Oe.

Moreover, as can be ascertained from FIG. 3*b*, the conventionally annealed alloy therein exhibits a lower value of $|df_r/dH_b|\approx 640$ Hz/Oe, but has a cobalt content of 15 at %. This is a better value than the values exhibited in FIGS. 8 and 9, thereby demonstrating that when conventional transverse field annealing is employed, a higher cobalt content is necessary in order to reduce the value of $|df_r/dH_b|$.

As noted above, however, by subjecting an alloy having a low cobalt content, or a cobalt-free alloy, to thermal treatment in the presence of a perpendicular (non-transverse) magnetic field, it is possible to set a linear B-H loop and simultaneously to achieve a low-frequency dependency which is clearly below 400 Hz/Oe, and can even be made close to 0, without any significant loss in signal amplitude. At the same time, a very high change of the resonant frequency $f_r$, of significantly more than one kHz, is achieved when the pre-magnetization field is removed, i.e., when a marker embodying a resonator composed of amorphous magnetostrictive alloy processed in this manner is deactivated.

As noted earlier, avoiding the use of any cobalt at all, or employing only a very low amount of cobalt, offers the significant advantage of lower raw material costs.

As can be seen from the illustrated examples, the position of the minimum of the resonant frequency, i.e., the field strength at which $|df_r/dH_b|\approx 0$ applies, can be arbitrarily placed by means of alloy composition selection and variation of the annealing time and annealing temperature. For resonators, as noted above, the typical field strength at which it is important for the aforementioned zero value to lie is between 6 and 7 Oe. Thus, for resonators intended for use in magnetomechanical electronic article surveillance systems, the alloy and the thermal treatment are designed so as to produce a minimum of the resonant frequency change between 6 and 7 Oe. The alloy composition $Fe_{35}Co_5Ni_{40}Si_4B_{16}$ is thus ideally suited for this purpose after a thermal treatment of fifteen minutes at approximately 350° C. A value of the field strength at which $|df_r/dH_b|\approx 0$ applies that is slightly too high for this purpose occurs given the composition $Fe_{62}Ni_{20}Si_2B_{16}$ after the same thermal treatment. This alloy composition, however, can be matched to the desired target value of 6–7 Oe by shortening the duration of the thermal treatment. A shortening of the duration of the thermal treatment is also an economic advantage. Time spans of a few seconds are ideally desired for the thermal treatment. The time of the thermal treatment can be reduced by lowering the Si content and correspondingly increasing the Ni content, possibly also accompanied by a slight increase in cobalt.

The alloy samples represented in all of the above figures were strips cut from ribbon and being 6 mm wide, 38 mm long, and approximately 20–30 $\mu$m thick. The samples in FIGS. 3*a* and 3*b* were annealed for approximately 7 s at 360° C. The samples in each of FIGS. 4, through 9 were annealed at 350° C. for 15 min.

It is also possible to set the resonant frequency $f_r$ of the resonator to a desired value by a slight adaptation of the length of the strip (cut from the processed ribbon) which is employed as the resonator. The resonant frequency $f_r$ is related to the length of the resonator by the known relationship $$f_r = 0.5L(E/D)^{0.5}$$

wherein L is the strip length, E is the Young's modulus of the strip, and D is the density of the strip. An advantage of the inventive resonator is that, given a strip of the same length as a conventional resonator, the inventive resonator will have a lower resonant frequency. This means that in order to achieve a strip which mechanically oscillates at a resonant frequency of 58 kHz, as is currently standard, the strip forming the resonator can be shortened by up to 20% compared to a conventional resonator, thereby not only saving in material costs, but also allowing a smaller marker to be produced.

Of course, other resonators can be designed which operate at a different resonant frequency and at a different field strength, in order to meet different needs.

As one further example of the effectiveness of the inventive combination of annealing in the presence of a perpendicular field and composition selection, an alloy composition was selected among compositions which were clearly indicated in the prior art as failing to have the desired properties suitable for use in a magnetomechanical article surveillance system, when conventionally annealed in the presence of a transverse magnetic field. For this purpose, an alloy having the composition $Co_2Fe_{40}Ni_{40}B_{13}Si_5$ (composition C from Table II in the aforementioned U.S. Pat. No. 5,628,840) was annealed in the presence of a perpendicular magnetic field. All of the alloys disclosed in U.S. Pat. No. 5,628,840 were stated therein to have been annealed in the presence of a transverse field, and U.S. Pat. No. 5,628,840 at column 7, lines 50–53 explicitly states that alloy C was unable to be set, given that type of annealing, with magnetic properties which were desirable from the standpoint of operation in a resonant marker system.

Figure 12:
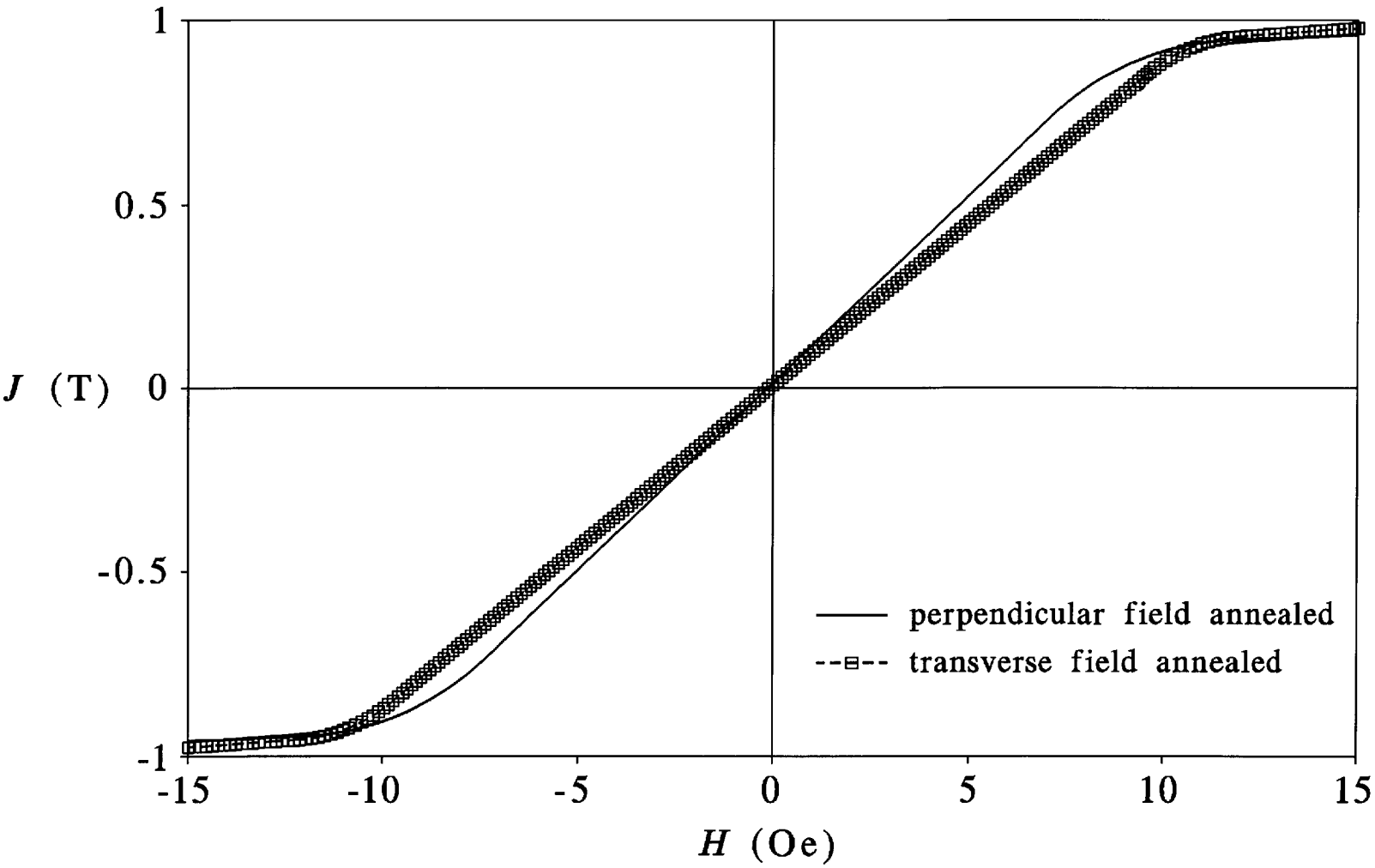
FIG. 12 shows the B-H loop for an exemplary alloy composition $Fe_{40}Co_2Ni_{40}Si_5B_{13}$ annealed in a perpendicular magnetic field in accordance with the invention.
Figure 13:
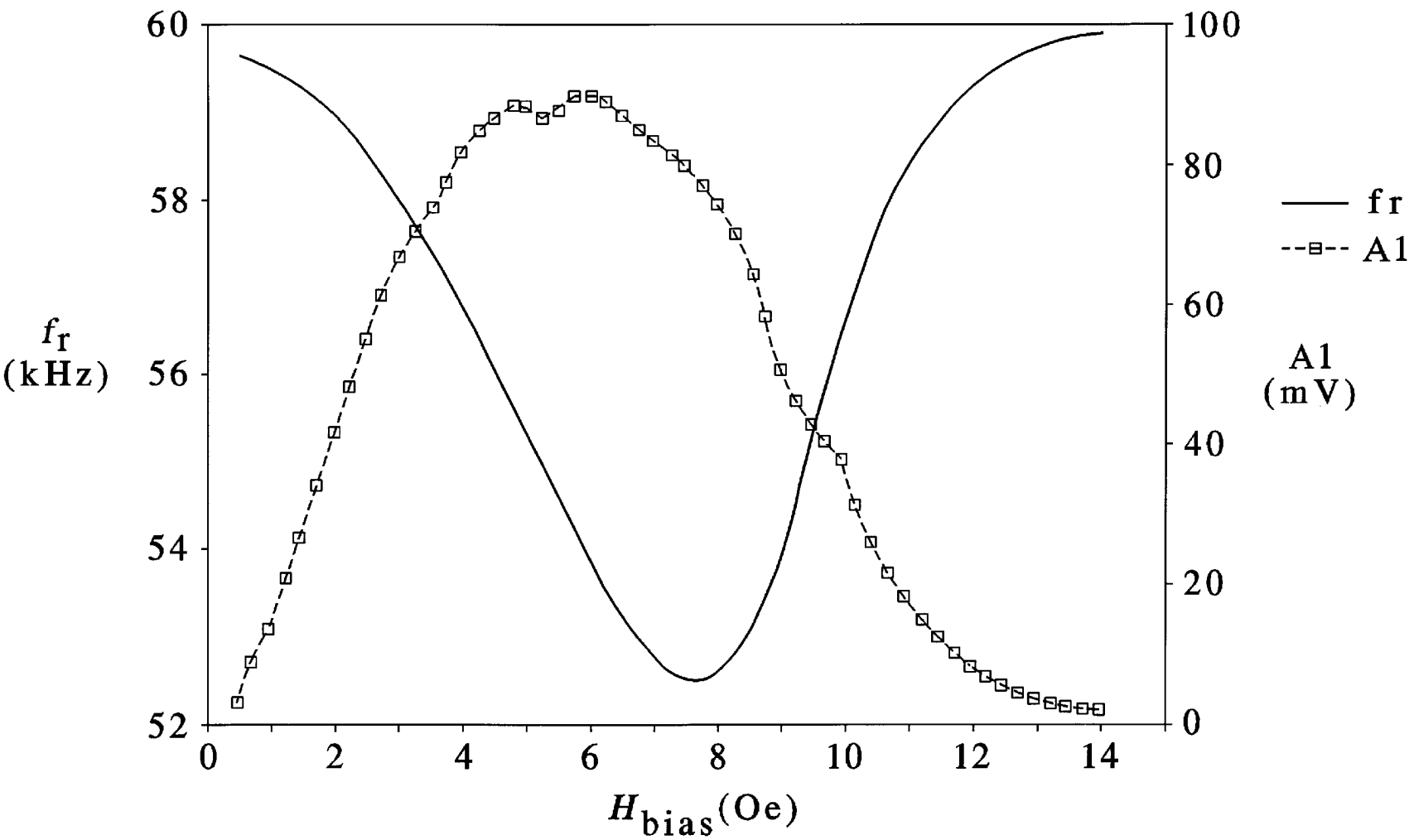
FIG. 13 shows the respective dependencies of the resonant frequency and the signal amplitude of the exemplary alloy $Fe_{40}Co_2Ni_{40}Si_5B_{13}$ after annealing in a perpendicular field.
Figure 14:
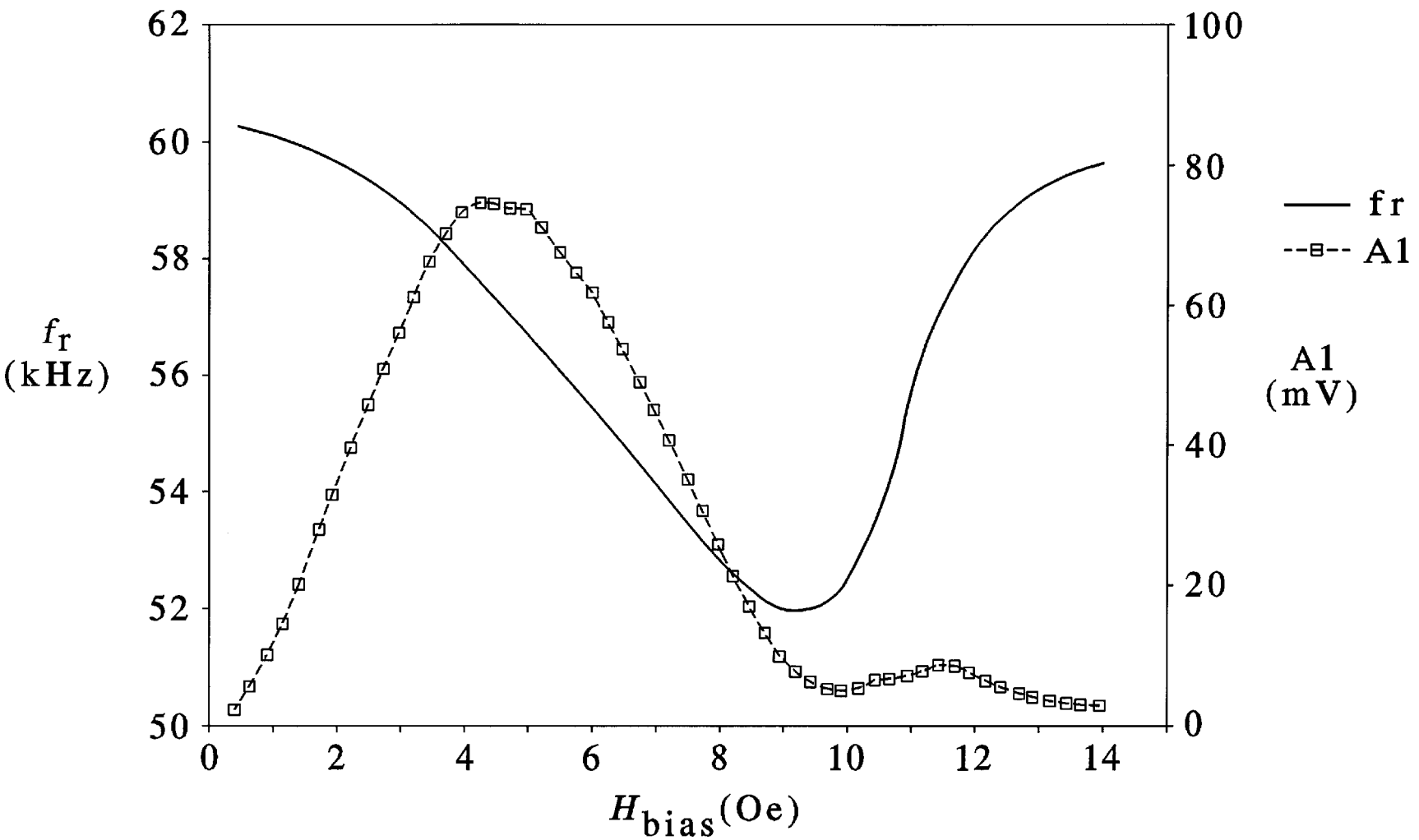
FIG. 14 shows the respective dependencies of the resonant frequency and the signal amplitude of the exemplary alloy $Fe_{40}Co_2Ni40Si_5B_{13}$ after annealing in a transverse field, not in accordance with the invention.
Figure 15:
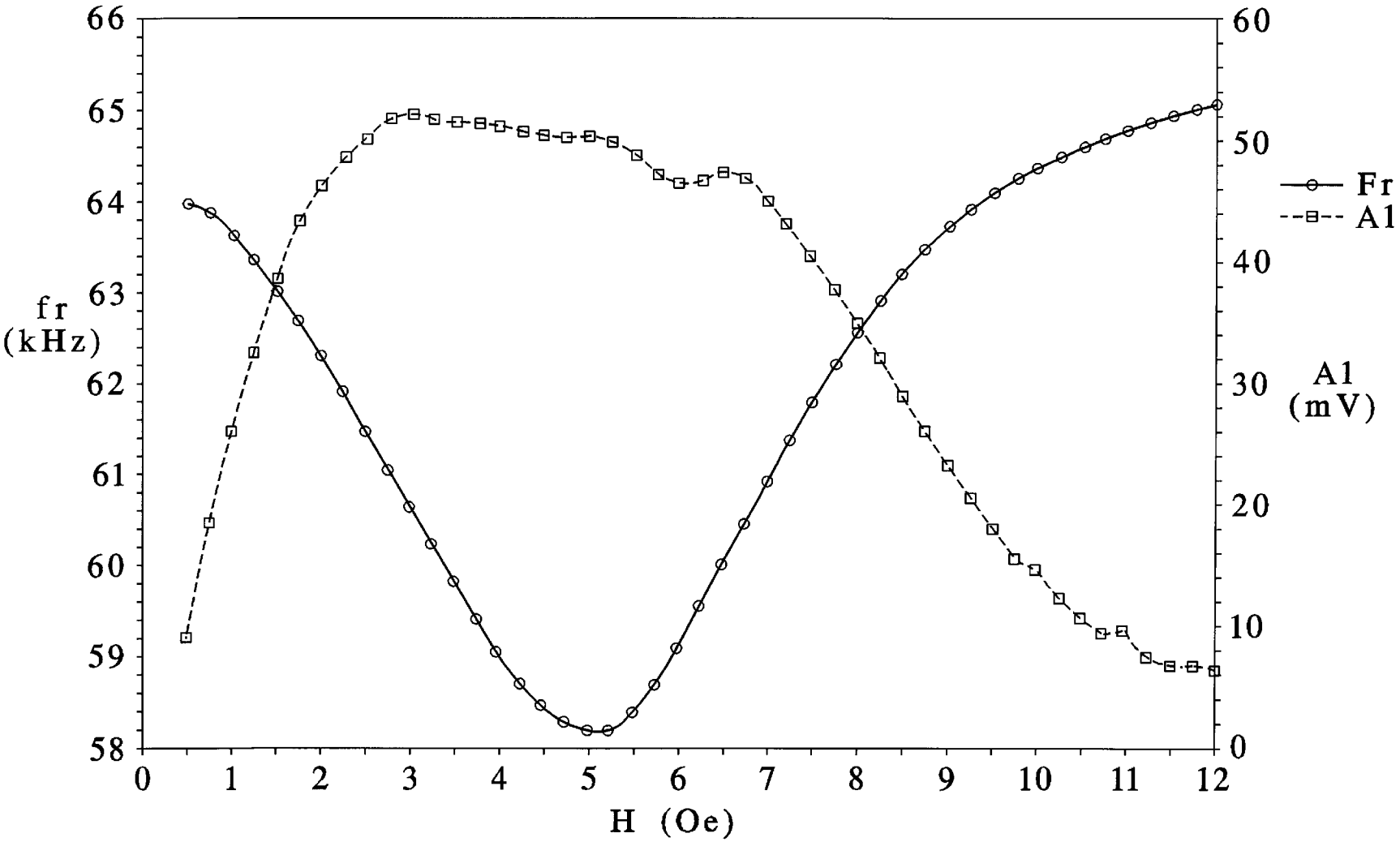
FIG. 15 shows the respective dependencies of the resonant frequency and the signal amplitude of the exemplary alloy $Fe_{40}Co_2Ni_{40}Si_5B_{13}$ after very brief annealing in a perpendicular field.

When this alloy composition, which is within the above-identified inventive formula, was subjected in accordance with the present invention to annealing in the presence of a perpendicular magnetic field, by contrast, it exhibited a value of $|df_r/dH_b|<400$ Hz/Oe, as well as producing a high initial amplitude at a location where the resonant frequency is approaching a minimum, thereby making it eminently suitable for use as a resonator in a magnetomechanical article surveillance system. Moreover, a resonator produced from this alloy composition in accordance with the invention also exhibited the aforementioned significant change (greater than 1.2 kHz) in resonant frequency when the bias magnetic field was removed. Curves for this alloy composition comparable to the previously discussed curves are shown in FIGS. 12, 13 and 14. FIG. 15 shows the respective dependencies of $f_r$ and A1 for this alloy produced in a further annealing embodiment, namely after only a very brief annealing in a non-transverse magnetic field.

The effects of variations in the annealing process for the investigated alloys are shown in Tables I and II.

TABLE I

Examples for investigated alloy compositions

| No. | composition at % | $J_s$(T) | $\lambda_s$ (ppm) |
|---|---|---|---|
| 1 | $Fe_{62}Ni_{20}Si_2B_{16}$ | 1.44 | 33 |
| 2 | $Fe_{53}Ni_{30}Si_1B_{16}$ | 1.33 | 29 |
| 3 | $Fe_{40}Co_2Ni_{40}Si_5B_{13}$ | 1.03 | 19 |
| 4 | $Fe_{35}Co_5Ni_{40}Si_4B_{16}$ | 0.96 | 16 |

Table II Anisotropy field $H_k$, bias field $H_{min}$ die df/dH=0, resonant frequency $f_{r,min}$ at $H_{min}$, signal amplitude A1 (1 ms after excitation with 1.6 ms long tone bursts of about 18 mOe peak amplitude) at $H_{min}$ and Q at $H_{min}$ after perpendicular field annealing. Batch annealing was performed with about 500 stacked pieces in a perpendicular field of about 3 kOe, reel-to-reel annealing was performed with a continuous strip in a perpendicular field of about 10 kOe (produced by an electromaget) in an oven with appr. a 10 cm long homogenous temperature zone. L is the resonator length. The ribbon width was 6 mm; the thickness about 25 $\mu$m

| Alloy No | anneal treatment | L (mm) | $H_k$ (Oe) | $H_{min}$ (Oe) | $f_{r,min}$ (kHz) | A1 (mV) | Q |
|---|---|---|---|---|---|---|---|
| 1 | 15 min 350° C. batch | 38.0 | 10.2 | 8.9 | 49.3 | 58 | 105 |
| 2 | 1.5 m/min 350° C. reel-to-reel | 38.0 | 8.4 | 6.7 | 49.6 | 50 | 109 |
| 3 | 15 min 300° C. batch | 38.0 | 9.2 | 7.8 | 52.5 | 77 | 181 |
| 3 | 0.5 m/min 350° C. reel-to-reel | 38.0 | 6.6 | 5.4 | 51.3 | 58 | 131 |
| 3 | 0.5 m/min 325° C. reel-to-reel | 38.0 | 6.5 | 4.8 | 52.5 | 62 | 149 |
| 3 | 0.5 m/min 350° C. reel-to-reel | 33.6 | 7.2 | 5.8 | 58.1 | 51 | 147 |
| 3 | 0.5 m/min 325° C. reel-to-reel | 34.4 | 6.9 | 5.0 | 58.2 | 50 | 148 |
| 4 | 15 min 350° C. batch | 38.0 | 7.4 | 6.5 | 53.5 | 64 | 154 |

Note an annealing speed of 1 m/min corresponds to a short annealing time of about 6 seconds. Or, if the furnace is 1 m instead of 10 cm this would correspond to an annealing speed of 10 m/min.

Figure 10A:
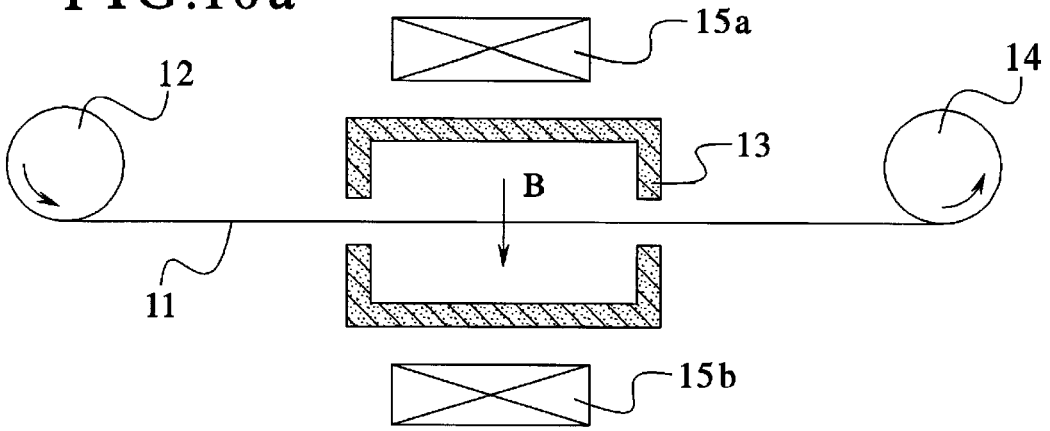
FIGS. 10*a* and 10*b* respectively show a side view and an end view of a first embodiment of an annealing process in accordance with the principles of the present invention.
Figure 10B:
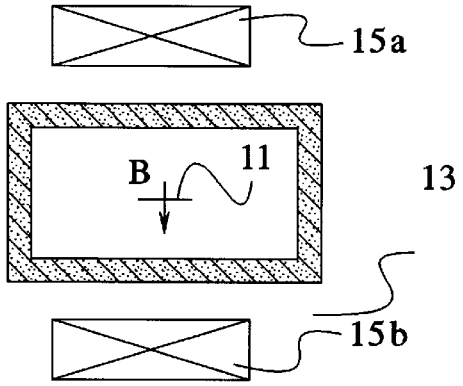

A first example of an annealing process in accordance with the invention is shown in FIGS. 10*a* and 10*b*, FIG. 10*a* showing a side view and FIG. 10*b* showing an end view. As shown in FIGS. 10*a* and 10*b*, amorphous ribbon 11, having a composition within the inventive formula, is removed from a rotating supply reel 12 and is passed through an annealing chamber 13, and is rewound on a take-up reel 14. The annealing chamber 13 can be any suitable type of annealing furnace, wherein the temperature of the ribbon 11 is elevated such as by direct heat from a suitable heat source or by passing electric current through the ribbon 11. While in the annealing chamber 13, the ribbon 11 is also subjected to a magnetic field B produced by a schematically indicated magnet arrangement 15*a* and 15*b*. The magnetic field B has a magnitude of at least 2000 Oe, preferably more, and is perpendicular to the longitudinal axis (longest extent) of the ribbon 11, and is out of the plane of the ribbon 11, i.e., the magnetic field B is parallel to a planar surface normal of the ribbon 11. The geometrical orientation of the magnetic field B relative to the ribbon 11 is also shown in the end view illustrated in FIG. 10*b*.

Figure 11A:
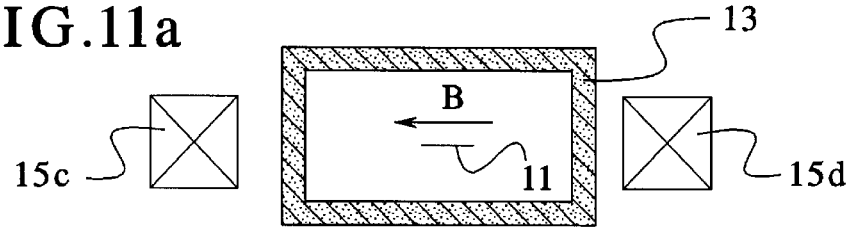
FIGS. 11*a* and 11*b* respectively show an end view and a top view of a second embodiment of an annealing process in accordance with the principles of the present invention.
Figure 11B:
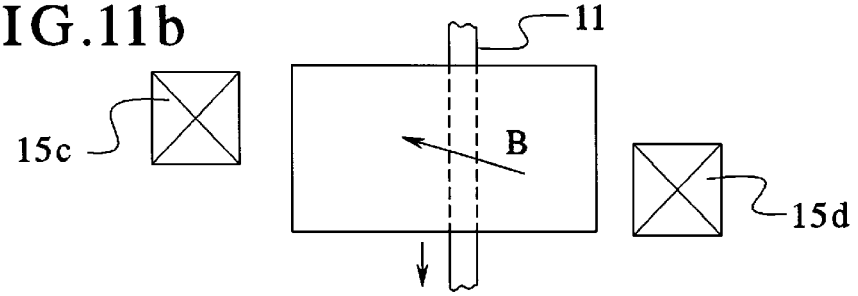

As noted above, the aforementioned magnetic properties making the inventive resonator suitable for use in a magnetomechanical article surveillance system can also be produced by non-transverse annealing in the plane of the ribbon 11. An annealing process for accomplishing this is shown in FIGS. 11*a* and 11*b*. In this embodiment of the annealing process, the magnetic field B is oriented in the plane of the ribbon 11, but at an angle relative to the longitudinal axis of the ribbon 11 which significantly deviates from 90°. As noted above, conventional transverse annealing, although in the plane of the ribbon, has always been conducted with a magnetic field oriented perpendicularly to the longitudinal axis of the ribbon. A differently oriented magnetic arrangement 15*c* and 15*d* is employed in the example shown in FIGS. 11*a* and 11*b*.

The types of magnetic fields respectively shown in FIGS. 10*a*, 10*b* and 11*a*, 11*b* can generically be described as non-transverse fields, based on the definition of a transverse field as being in the plane of the ribbon and oriented at 90° relative to the longitudinal axis of the ribbon. When used by itself, the non-transverse field annealing shown in the second example of FIGS. 11*a* and 11*b*, in order to produce the aforementioned magnetic properties which are suitable for a resonator for use in a magnetomechanical article surveillance system, must operate on an alloy having a higher cobalt content than given the annealing in a perpendicular magnetic field in the embodiment of FIGS. 10*a* and 10*b*. Therefore, combinations of the perpendicular and oblique fields can be employed with suitable adjustment of the alloy composition, wherein a magnetic field is produced that is a vectorial addition of the perpendicular field shown in the example of FIGS. 10*a* and 10*b* and the oblique field shown in the examples of FIGS. 11*a* and 11*b*.

Although modifications and changes may be suggested by those skilled in the art, it is the intention of the inventor to embody within the patent warranted hereon all changes and modifications as reasonably and properly come within the scope of his contribution to the art.

I claim as my invention:

1. A magnetomechanical electronic article surveillance system comprising:

a marker comprising a bias element which produces a bias magnetic field $H_b$ and a resonator, said resonator formed by a planar strip of an amorphous magnetostrictive alloy having a composition $Fe_aCo_bNi_cSi_xB_yM_z$ wherein a, b, c, x, y, and z are at % and a+b+c+x+y+z=100, a+b+c>75, a>15, b<20, c>5 and z<3, wherein M is at least one element selected from the group consisting of C, P, Ge, Nb, Mo, Cr and Mn, said amorphous magnetostrictive alloy having a resonant frequency $f_r$ which is a minimum at a field strength $H_{min}$ and having a linear B-H loop up to at least a field strength which is about 0.8 $H_{min}$ and a uniaxial anisotropy perpendicular to the plane of said strip with an anisotropy field strength $H_k$ which is at least as large as $H_{min}$ and, when driven by an alternating signal burst in the presence of a bias field $H_b$, producing a signal having an amplitude which is a minimum of approximately 50% of a maximum obtainable amplitude relative to said bias field $H_b$ in a range of $H_b$ between 0 and 10 Oe;

transmitter means for exciting said marker for causing said resonator to mechanically resonate and to emit said signal at said resonant frequency;

receiver means for receiving said signal from said resonator at said resonant frequency;

synchronization means connected to said transmitter means and to said receiver means for activating said receiver means for detecting said signal at said resonant frequency at a time after said transmitter means excites said marker; and an alarm, said receiver means comprising means for triggering said alarm if said signal at said resonant frequency from said resonator is detected by said receiver means.

2. A magnetomechanical electronic article surveillance system as claimed in claim 1 wherein said resonant frequency $f_r$ changes by at least 1.2 kHz when said bias field $H_b$ is removed.

3. A magnetomechanical electronic article surveillance system as claimed in claim 1 wherein $|df_r/dH_b| \approx 0$ in said range between 6 and 7 Oe.

4. A magnetomechanical electronic article surveillance system as claimed in claim 1 having a composition $Co_2Fe_{40}Ni_{40}Si_5B_{13}$.

5. A magnetomechanical electronic article surveillance system as claimed in claim 1 having a composition $Fe_{62}Ni_{20}Si_2B_{16}$.

6. A magnetomechanical electronic article surveillance system as claimed in claim 1 having a composition $Fe_{35}Co_5Ni_{40}Si_4B_{16}$.

7. A magnetomechanical electronic article surveillance system as claimed in claim 1 wherein a+b+c>79.

8. A magnetomechanical electronic article surveillance system as claimed in claim 1 wherein c<10 and b<4.

9. A magnetomechanical electronic article surveillance system as claimed in claim 1 wherein b<10.

10. A magnetomechanical electronic article surveillance system as claimed in claim 1 wherein a<30 and c>30.

11. A magnetomechanical electronic article surveillance system as claimed in claim 1 wherein $H_{min}$ is in a range between about 5 and about 8 Oe.

12. A magnetomechanical electronic article surveillance system as claimed in claim 1 wherein $H_{min}$ is about 0.8 $H_k$.

13. A magnetomechanical electronic article surveillance system as claimed in claim 1 wherein $H_k$ is about 6 Oe.

14. A magnetomechanical electronic article surveillance system as claimed in claim 1 wherein said B-H loop is linear up to a range of between 4 and 5 Oe.

15. A magnetomechanical electronic article surveillance system as claimed in claim 1 wherein $f_r$ changes dependent on $H_b$ by less than 400 Hz/Oe in a range of $H_b$ between about 5 and about 8 Oe.

16. A magnetomechanical electronic article surveillance system as claimed in claim 1 wherein said planar strip of amorphous magnetostrictive alloy is annealed in a magnetic field oriented substantially perpendicularly to, and out of, said plane of said strip.

17. A resonator for use in a marker in a magnetomechanical electronic article surveillance system, said resonator comprising:

a planar strip of an amorphous magnetostrictive alloy having a composition $Fe_aCo_bNi_cSi_xB_yM_z$ wherein a, b, c, x, y, and z are at % and a+b+c+x+y+z=100, a+b+c>75, a>15, b<20, c>5 and z<3, wherein M is at least one element selected from the group consisting of C, P, Ge, Nb, Mo, Cr and Mn, said amorphous magnetostrictive alloy having a resonant frequency $f_r$ which is a minimum at a field strength $H_{min}$ and having a linear B-H loop up to at least a field strength which is about 0.8 $H_{min}$ and a uniaxial anisotropy perpendicular to the plane of said strip with an anisotropy field strength $H_k$ which is at least as large as $H_{min}$ and, when driven by an alternating signal burst in the presence of a bias field $H_b$, producing a signal at said resonant frequency having an amplitude which is a minimum of approximately 50% of a maximum obtainable amplitude relative to said bias field $H_b$ in a range of $H_b$ between 0 and 10 Oe.

18. A resonator as claimed in claim 17 wherein said resonant frequency $f_r$ changes by at least 1.2 kHz when said bias field $H_b$ is removed.

19. A resonator as claimed in claim 17 wherein $|df_r/dH_b| \approx 0$ in said range between 6 and 7 Oe.

20. A resonator as claimed in claim 17 having a composition $Co_2Fe_{40}Ni_{40}Si_5B_{13}$.

21. A resonator as claimed in claim 17 having a composition $Fe_{62}Ni_{20}Si_2B_{16}$.

22. A resonator as claimed in claim 17 having a composition $Fe_{35}Co_5Ni_{40}Si_4B_{16}$.

23. A resonator as claimed in claim 17 wherein a+b+c>79.

24. A resonator as claimed in claim 17 wherein c<10 and b<4.

25. A resonator as claimed in claim 17 wherein b<10.

26. A resonator as claimed in claim 17 wherein a<30 and c>30.

27. A resonator as claimed in claim 17 wherein $H_{min}$ is in a range between about 5 and about 8 Oe.

28. A resonator as claimed in claim 17 wherein $H_{min}$ is about 0.8 $H_k$.

29. A resonator as claimed in claim 17 wherein $H_k$ is about 6 Oe.

30. A resonator as claimed in claim 17 wherein said B-H loop is linear up to a range of between 4 and 5 Oe.

31. A resonator as claimed in claim 17 wherein $f_r$ changes dependent on $H_b$ by less than 400 Hz/Oe in a range of $H_b$ between about 5 and about 8 Oe.

32. A resonator as claimed in claim 17 wherein said planar strip of amorphous magnetostrictive alloy is annealed in a magnetic field oriented substantially perpendicularly to, and out of, said plane of said strip.

33. A marker for use in a magnetomechanical electronic article surveillance system, said marker comprising:

a bias element which produces a bias magnetic field $H_b$;

a resonator disposed adjacent said bias element comprising a planar strip of an amorphous magnetostrictive alloy having a composition $Fe_aCo_bNi_cSi_xB_yM_z$ wherein a, b, c, x, y, and z are at % and a+b+c+x+y+z=100, a+b+c>75, a>15, b<20, c>5 and z<3, wherein M is at least one element selected from the group consisting of C, P, Ge, Nb, Mo, Cr and Mn, said amorphous magnetostrictive alloy having a resonant frequency $f_r$ which is a minimum at a field strength $H_{min}$ and having a linear B-H loop up to at least a field strength which is about 0.8 $H_{min}$ and a uniaxial anisotropy perpendicular to the plane of said strip with an anisotropy field strength $H_k$ which is at least as large as $H_{min}$ and, when driven by an alternating signal burst in the presence of said bias field $H_b$, producing a signal at said resonant frequency having an amplitude which is a minimum of approximately 50% of a maximum obtainable amplitude relative to said bias field $H_b$ in a range of $H_b$ between 0 and 10 Oe; and a housing encapsulating said bias element and said resonator.

34. A marker as claimed in claim 33 wherein said resonant frequency $f_r$ changes by at least 1.2 kHz when said bias field $H_b$ is removed.

35. A marker as claimed in claim 33 wherein $|df_r/dH_b| \approx 0$ in said range between 6 and 7 Oe.

36. A marker as claimed in claim 33 having a composition $Co_2Fe_{40}Ni40Si_5B_{13}$.

37. A marker as claimed in claim 33 having a composition $Fe_{62}Ni_{20}Si_2B_{16}$.

38. A marker as claimed in claim 33 having a composition $Fe_{35}Co_5Ni_{40}Si_4B_{16}$.

39. A marker as claimed in claim 33 wherein a+b+c>79.

40. A marker as claimed in claim 33 wherein c<10 and b<4.

41. A marker as claimed in claim 33 wherein b<10.

42. A marker as claimed in claim 33 wherein a<30 and c>30.

43. A resonator as claimed in claim 33 wherein $H_{min}$ is in a range between about 5 and about 8 Oe.

44. A resonator as claimed in claim 33 wherein $H_{min}$ is about 0.8 $H_k$.

45. A resonator as claimed in claim 33 wherein $H_k$ is about 6 Oe.

46. A resonator as claimed in claim 33 wherein said B-H loop is linear up to a range of between 4 and 5 Oe.

47. A resonator as claimed in claim 33 wherein $f_r$ changes dependent on $H_b$ by less than 400 Hz/Oe in a range of $H_b$ between about 5 and about 8 Oe.

48. A resonator as claimed in claim 33 wherein said planar strip of amorphous magnetostrictive alloy is annealed in a magnetic field oriented substantially perpendicularly to, and out of, said plane of said strip.

49. A method of making a resonator for use in a magnetomechanical electronic article surveillance system, comprising the steps of:

providing a planar amorphous magnetostrictive alloy having a composition $Fe_aCo_bNi_cSi_xB_yM_z$ wherein a, b, c, x, y, and z are at % and a+b+c+x+y+z=100, a+b+c >75, a>15, b<20, c>5 and z<3, wherein M is at least one element selected from the group consisting of C, P, Ge, Nb, Mo, Cr and Mn; and annealing said planar amorphous magnetostrictive alloy in a magnetic field having a direction perpendicular to, and out of, the plane of said planar amorphous magnetostrictive alloy, so as to produce a resonator having a resonant frequency $f_r$ which is a minimum at a field strength $H_{min}$ and having a linear B-H loop up to at least a field strength which is about 0.8 $H_{min}$ and a uniaxial anisotropy perpendicular to the plane of said strip with an anisotropy field strength $H_k$ which is at least as large as $H_{min}$ and, when driven by an alternating signal burst in the presence of a bias field $H_b$, producing a signal at said resonant frequency having an amplitude which is a minimum of approximately 50% of a maximum obtainable amplitude relative to said bias field $H_b$ in a range of $H_b$ between 0 and 10 Oe.

50. A method as claimed in claim 49 wherein the step of annealing planar amorphous magnetostrictive alloy comprises annealing said planar amorphous magnetostrictive alloy at a temperature in a range between approximately 250° C. and approximately 430° C. for less than one minute.

51. A method of making a marker for use in a magnetomechanical electronic article surveillance system, comprising the steps of:

providing a planar amorphous magnetostrictive alloy having a composition $Fe_aCo_bNi_cSi_xB_yM_z$ wherein a, b, c, x, y, and z are at % and a+b+c+x+y+z=100, a+b+c >75, a>15, b<20, c>5 and z<3, wherein M is at least one element selected from the group consisting of C, P, Ge, Nb, Mo, Cr and Mn; and annealing said planar amorphous magnetostrictive alloy in a magnetic field having a direction perpendicular to, and out of, the plane of said planar amorphous magnetostrictive alloy, so as to produce a resonator having a resonant frequency $f_r$ which is a minimum at a field strength $H_{min}$ and having a linear B-H loop up to at least a field strength which is about 0.8 $H_{min}$ and a uniaxial anisotropy perpendicular to the plane of said strip with an anisotropy field strength $H_k$ which is at least as large as $H_{min}$ and, when driven by an alternating signal burst in the presence of a bias field $H_b$, producing a signal at said resonant frequency having an amplitude which is a minimum of approximately 50% of a maximum obtainable amplitude relative to said bias field $H_b$ in a range of $H_b$ between 0 and 10 Oe;

placing said resonator adjacent a magnetized ferromagnetic bias element which produces said bias magnetic field $H_b$; and encapsulating said resonator and said bias element in a housing.

52. A method as claimed in claim 51 wherein the step of annealing planar amorphous magnetostrictive alloy comprises annealing said planar amorphous magnetostrictive alloy at a temperature in a range between approximately 250° C. and approximately 430° C. for less than one minute.

* * * * *